US007611395B2

(12) United States Patent
Bonsembiante

(10) Patent No.: US 7,611,395 B2
(45) Date of Patent: Nov. 3, 2009

(54) ILLUMINATING BALLOON INFLATABLE WITH AIR

(75) Inventor: Andrea Bonsembiante, Giavera del Montello (IT)

(73) Assignee: Intercomm S.R.L., Arcade (TV) (IT)

( * ) Notice: Subject to any disclaimer, the term of this patent is extended or adjusted under 35 U.S.C. 154(b) by 465 days.

(21) Appl. No.: 11/289,482

(22) Filed: Nov. 30, 2005

(65) Prior Publication Data

US 2007/0123140 A1 May 31, 2007

(51) Int. Cl.
*A63H 3/06* (2006.01)
*A63H 33/26* (2006.01)
*A63J 17/00* (2006.01)

(52) U.S. Cl. ..... 446/220; 446/219; 362/253

(58) Field of Classification Search ..... 446/219, 446/220, 221, 222, 225, 226; 362/34, 96, 362/97, 363; 473/570
See application file for complete search history.

(56) References Cited

U.S. PATENT DOCUMENTS

| | | | | | |
|---|---|---|---|---|---|
| 2,656,293 | A | * | 10/1953 | Huch | 156/264 |
| 2,767,941 | A | | 10/1956 | Gegner et al. | |
| 3,182,932 | A | * | 5/1965 | Winker | 244/31 |
| 3,229,976 | A | * | 1/1966 | Allen, Jr. | 473/570 |
| 3,610,916 | A | | 10/1971 | Meehan | |
| 3,839,631 | A | * | 10/1974 | Goddard | 362/362 |
| 4,463,513 | A | | 8/1984 | Wallace | |
| 4,704,934 | A | | 11/1987 | Nosrati | |
| 5,215,492 | A | * | 6/1993 | Kubiatowicz | 446/219 |
| 5,795,211 | A | * | 8/1998 | Carignan et al. | 446/220 |
| 5,931,412 | A | * | 8/1999 | Carloni | 244/31 |
| 5,947,581 | A | * | 9/1999 | Schrimmer et al. | 362/96 |
| 6,012,826 | A | * | 1/2000 | Chabert | 362/363 |
| 6,644,843 | B2 | * | 11/2003 | Chin-Cheng | 362/97 |
| 7,264,382 | B2 | * | 9/2007 | Yoshimori et al. | 362/431 |
| 2002/0171927 | A1 | * | 11/2002 | Barnes, III | 359/451 |
| 2004/0042217 | A1 | * | 3/2004 | Chabert et al. | 362/363 |
| 2004/0170022 | A1 | | 9/2004 | Yoshimori et al. | |
| 2004/0226649 | A1 | * | 11/2004 | Van Dyke et al. | 156/219 |
| 2004/0233674 | A1 | * | 11/2004 | Vanderschuit | 362/352 |

FOREIGN PATENT DOCUMENTS

| | | |
|---|---|---|
| DE | 3015962 | 11/1981 |
| EP | 1 403 580 | 3/2004 |
| FR | 717535 | 1/1932 |
| GB | 1178815 | 1/1970 |

OTHER PUBLICATIONS

World Wide Web Website http://www.powermoon.de/ger.php?p=german, with an English language translation of the front page of the website.
World Wide Web Website http://www.heatwaves.nl/inhoud/dui/principe.html, with an English language translation of the front page of the website.
World Wide Web Website http://www.bayer.it/web/Bayer-IT.nsf/Web.

* cited by examiner

*Primary Examiner*—Nini Legesse
(74) *Attorney, Agent, or Firm*—Greenblum & Bernstein, P.L.C.

(57) ABSTRACT

The present invention concerns a balloon inflatable with air and containing a light source (lamp) inside. The balloon (1) consists of a plurality of segments (5, 5', 5", etc.) made from polyester or polyamide (nylon), which along a meridian line (6, 6', 6", etc.) are mutually connected. This connection according to the invention is effected by high frequency (HF) welding, which other than sewing technologies ensures that owing to the melting of at least one intermediate layer of thermoplastic material absolute air-tightness of the connecting zone of the neighboring segments, and thus of the whole balloon (1), can be obtained.

16 Claims, 3 Drawing Sheets

ILLUMINATING BALLOON INFLATABLE WITH AIR

BACKGROUND OF THE INVENTION

1. Field of the Invention

The present invention concerns a balloon for illumination purposes inflatable with air. The balloon, at its centre, contains an illumination light source in the form of an electric lamp, and includes a plurality of segments forming meridians, which are mutually interconnected in such a manner that they form an essentially spherical body. The segments are made from a particularly air-impermeable fabric and, at the lower pole of the sphere, a connecting disc is provided so that all segments merge and connect the balloon in a substantially airtight manner with a connecting rod.

2. Discussion of Background Information

Realization and application of balloons of such type suitable for illuminating large open air event areas, such as squares, fields or ski runs, over the last years has become more frequent owing to the advantages offered by this type of illumination set-ups. Among these the ease of setting up of the plant is to be mentioned (where just a supporting rod is to be anchored on the ground, if not —as in the case of application of helium-filled balloons—merely an electric cable is sufficient), as well as the absence of any blinding effects owing to the fact that the light emitted from the balloon surface is diffuse and thus can not cause any blinding effects. This technology thus is ideally suited for setting up temporary illumination plants for large areas without requiring any costly fixed installation.

From practical applications various types of inflatable balloons are known containing a light source inside, which can be subdivided essentially into two categories, namely in balloons filled with a lighter-than-air gas on one hand, which float upward and are to be anchored to the ground merely like a blimp (captive balloon), and in air-filled balloons on the other hand.

In the first category e.g. the balloon HeliMax Powermoon is to be mentioned, made from a material called Levapren by the German Company Noelle Industrielle Umwelttechnik GmbH at Rheinberg and described in the internet under http://www.powermoon.de/ger.php?p=german.

This balloon can be produced with diameters of up to 5.5 m and behaves just like a blimp (captive balloon), which must be anchored to the ground using an array of cables in such a manner that it can not drift off. The helium-filled balloon, proposed for illumination purposes more than a century ago, implies the use of an inert lighter-than-air gas, normally helium, which requirement severely limits applicability. The use of a gas differing from air furthermore implies that the balloon be absolutely impermeable, not permitting any leaking of the balloon-gas into the surrounding air. The material used thus must be absolutely impermeable—which implies that very expensive materials are to be considered—and is not to contain any gas-permeable connecting areas or seams. These requirements render realization of helium-filled balloons extremely difficult and cost-intensive.

The other category of the inflatable balloons is the one of balloons inflatable with air. Balloons of this type according to the state of the art are easier to realize in comparison with the ones described above and handling is less complicated as air always is available in unlimited quantity. Such balloons of course do not float up from the ground but are to be supported on a suitable support rod, via which also the electric supply cable for the illumination and possibly also a pneumatic duct can lead serving for inflating the balloon at the beginning and, if needed, for maintaining the required filling pressure inside the balloon. Design-wise the advantage over helium-filled balloons is seen in that they can be manufactured using ordinary fabrics (such as polyester or nylon), which are of low cost and easily processed, if air-tightness is to be improved, by means of a surface treatment e.g. polyurethane coating, in order to permit realization of cost-efficient fabrics suitable for application in inflatable balloons.

Typical for this kind of balloon is the one produced and marketed under the name of Sunglobe by the company Intercomm srl at 31030 Arcade (Tv). This balloon is made from fabric and consists of a plurality of segments forming meridian lines along which the segments are interconnected in such a manner that an essentially spherical body is formed.

With this balloon the problem is that absolutely air-tight connecting seams between the segments must be obtained. According to the state of the art the segments are interconnected using simplest technology by sewing with threads in single or multiple seams. This solution, however does not permit obtaining sufficiently airtight connecting zones, causing the balloons produced in this manner do deflate and to tend to collapse over time, which forces the designer to provide a pump using which the inside pressure in the balloon is maintained by pumping fresh air into the balloon.

Numerous documents in the patent literature concern inflatable balloons for illumination purposes. Here the French patent FR 717535 of 1931 is to be cited, merely in the sense of an example, which shows an inflatable balloon on which it was tried to find a solution of the problem of sealing the closure of the inlet sleeve for the electric cable airtight. Further examples of inflatable balloons none of which, however, shows the segmental layout, which characterizes the present invention, are contained in the patent documents U.S. Pat. No. 4,463,513, U.S. Pat. No. 3,610,916, U.S. Pat. No. 4,704,934 or DE 3015962.

From the patent literature concerning balloons inflatable with air—or with a lighter-than-air gas—and equipped with an internal light source, as well as the manufacture thereof, no insight is gained concerning the joining of the segments forming the spherical balloon, except the technology of sewing the seams with thread along the segment rims. This system, however, cannot ensure the required tightness of the essentially spherical body forming the balloon, and thus special measures are to be taken in order to maintain the pressure constant inside the balloon.

SUMMARY OF THE INVENTION

Thus the present invention overcomes the disadvantages of the abovementioned known state of the art concerning the inflatable illuminating balloons consisting of mutually connected fabric segments, which together form a hollow body of substantially spherical shape.

According to the present invention, the fabric segments are mutually interconnected along a meridian line of the balloon using a high frequency (HF) welding process, which ensures the melting of at least one thermoplastic intermediate layer along a connecting and/or overlapping zone of two neighboring segments in such a manner that an airtight connection is established along the welding seams.

Joining the segments to form the spherical body—in practical use also called globe or ball—using a high frequency (HF) welding device permits melting of at least one layer of thermoplastic material, which is inserted in an overlapping zone between two neighboring segments, where the thermoplastic material of the intermediate layer can be a coating on the fabric forming the segments of the balloon, or can be a strip, which for the welding process is inserted into the overlapping and/or connecting zone. At any rate such melting of layer of thermoplastic material permits an absolutely airtight connecting zone along the welding seams and between two adjacent fabric segments to be obtained in such a manner that the objective of the present invention is met.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The present invention is described in more detail in the following with reference to the drawings showing in the.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
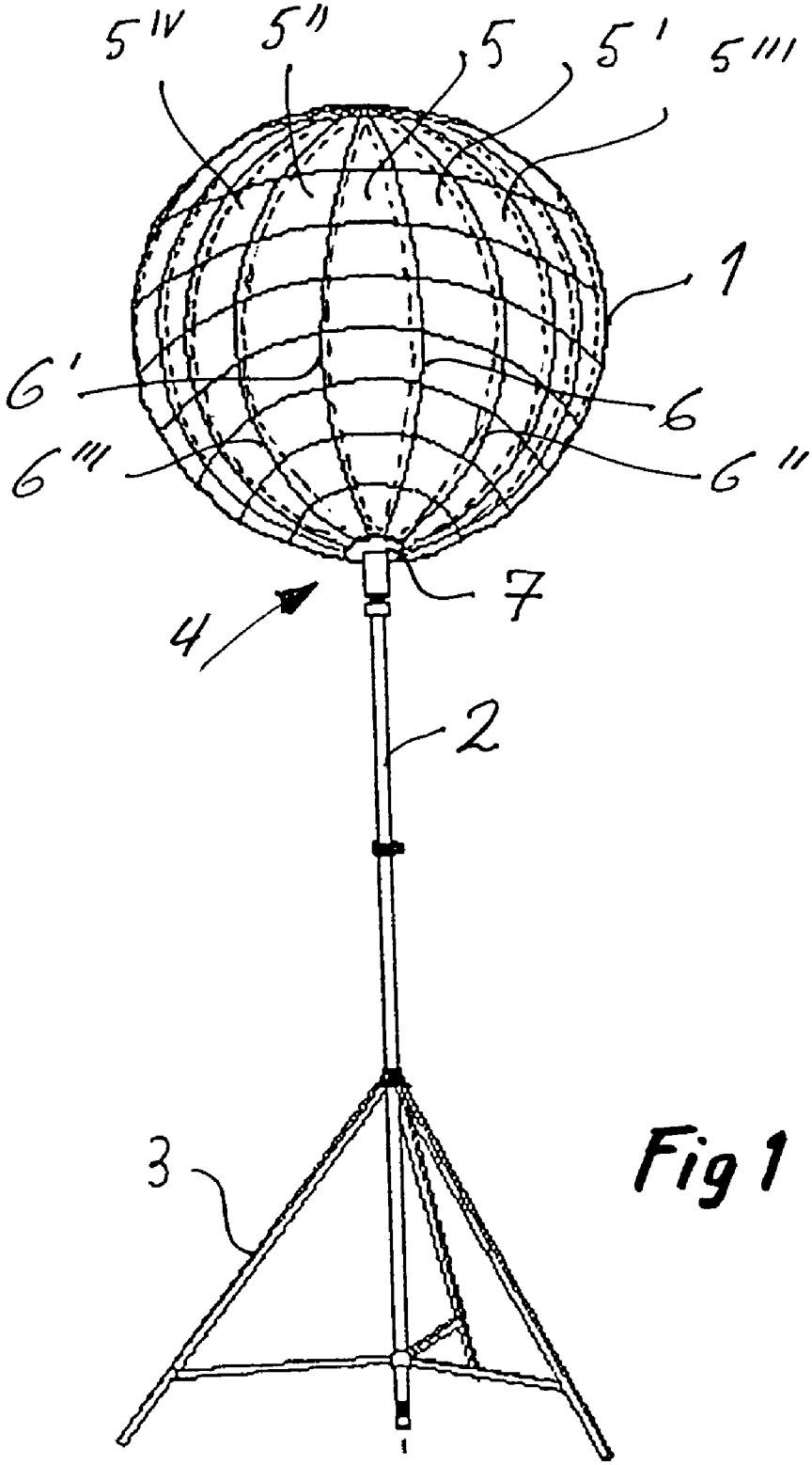
FIG. 1 An overall view of the inventive inflatable balloon with its main components.

In the FIG. 1 the essentially spherical shape of the body is designated 1, which forms the actual balloon (commercially often referred to also as illuminating globe or similar). The balloon 1, according to the object of the invention, is filled with compressed air and thus must be—other than the known and commercially available helium-filled balloons—supported by a supporting rod 2, which is fixed to the ground e.g. using a tripod 3 (or using any other type of fastening means). The rod 2 preferentially is laid out as a telescoping rod. Inside the balloon 1 an illuminating device is located (not shown in the Figure) which illuminates the balloon 1 from inside, the balloon 1 in turn emitting diffuse light in all directions—or only downwards if the balloon in its upper part is provided with a suitable reflecting cap.

The apparatus of course is equipped with all electric and mechanical devices required for feeding air into the balloon under slight above atmospheric pressure (of just a few millibar) as well as for supplying the apparatus with electric current. This arrangement corresponds to the known state of the art and is explained in folders and instruction sheets of the abovementioned Company Intercomm in detail for the balloon Sunglobe. Thus a more detailed description of the design details of the apparatus can be dispensed with here, the documents cited being referred to, which present a very detailed description of the inventive inflatable balloon. One aspect, important in the context of the present invention, which can be seen in the FIG. 1, is the fact that the balloon 1 consists of individual segments 5, 5', 5", 5''', 5$^{IV}$, etc., which are mutually interconnected along a meridian line 6, 6', 6", 6''', 6$^{IV}$, etc. From the FIG. 1 it also can be seen that at the lower pole 4 a connecting disc 7 is provided under which all the segments 5, 5', 5", 5''', 5$^{IV}$, etc., merge. With the help of this disc 7 the balloon 1 is fastened substantially airtight to the supporting rod 2, which serves as a support and also supports the air supply line.

The present invention thus only concerns the mutual connection of the fabric segments 5, 5', 5", 5''', 5$^{IV}$, etc., all other characteristics of the apparatus with the inflatable illuminating balloon, known from practical use and from the literature being taken into account.

Said connection according to the present invention is realized by welding the neighboring segments 5, 5', 5", 5''', etc. along a meridian line 6, 6', 6", 6''', etc., using a high frequency (HF) welding process. This welding process, which like the devices required for it are known as such, permits reliable and rapid melting of at least one intermediate layer of thermoplastic material—such as shown in detail in the FIGS. 2 through 5—along a connecting and/or overlapping zone of two neighboring segments 5, 5', 5", 5''', etc. Owing to this connection type using high frequency welding—for which at least one intermediate layer of thermoplastic material must be present—an absolutely airtight connection between two neighboring segments is obtained, which establishes the required characteristic of absolute air tightness of the whole balloon.

For realizing the present invention essentially two prerequisites must be fulfilled, namely:

1) An intermediate layer of thermoplastic material is to be present along a connecting and/or overlapping zone of two segments, the term intermediate layer being understood as a layer that rests against both segments. This can be effected in various manners as will be explained in the following with reference to some examples represented in the FIGS. 2 through 5.
2) Application of high frequency welding is effected using a so-called "High frequency welding press", which is powered by a high frequency generator. This is a well known technology used in many fields of application, which is new, however, in the application of manufacturing inflatable illuminating balloons. Regarding the design and the function of a "high frequency welding press" HF the large relevant literature is to be referred to, which is accessible in the internet and in the relevant folders by the various manufacturers producing such machines (compare e.g. the website http://www.heat-waves.nl/inhoud/dui/principe.html). The explanation of this technology thus is not to be extended further here and can be limited to the specific application shown in the FIG. 6, which is especially interesting here.

In the FIGS. 2 through 5 several preferred forms of realization of the present invention are represented, in which identical elements (or components) are designated using the same reference signs.

Figure 2:
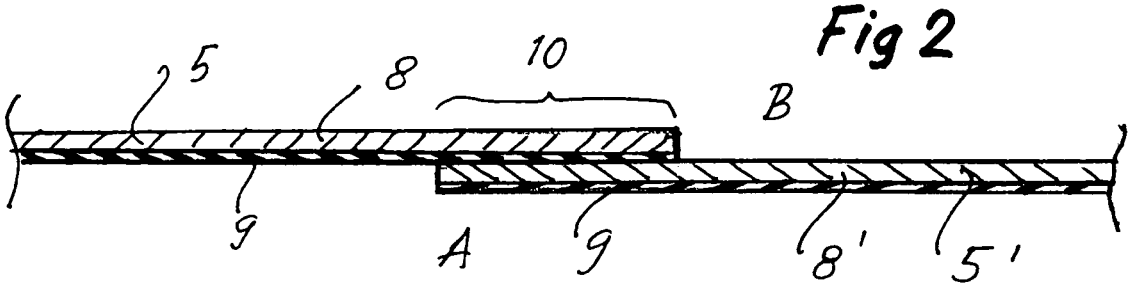
FIGS. 2 through 5 Variants of the high frequency welding mode applied to two neighboring segments where in the FIGS. 2 and 3 a seem of overlapping segments is shown and in the FIGS. 4 and 5 a seam of adjacent segments and welding with a covering strip is shown.

According to a first form of realization of the present invention, represented in all FIGS. 2 though 5, it is provided that the fabric 8 forming the segments 5, 5', 5", 5''', etc., is a fabric made from polyester or polyamide (nylon). Such fabrics today are used in countless applications in all fields and they are very cost efficient. Their low price offers the most interesting aspect in the context of the present invention in comparison to the known state of the art, according to which fabrics made from special fibers are to be used, which are much more expensive (e.g. Levaprene® by the company Bayer Leverkusen, Germany, which additionally is too be coated with synthetic rubber Conti Vitroflex®, which is light and transparent, produced by Conti Tech Elastomer Beschichtungen GmbH at Northeim, Germany—described on the website http://www.bayer.it/web/Bayer-IT.nsf/Web Tutti/54150 CE 46CB 0859 FC125DB000303717).

According to a further form of realization of the present invention it is preferred that the thermoplastic intermediate layer 9 is a layer lining the fabric 8 on its whole inside surface of the balloon 1 (FIG. 2) and consists of a polyurethane film.

Figure 3:
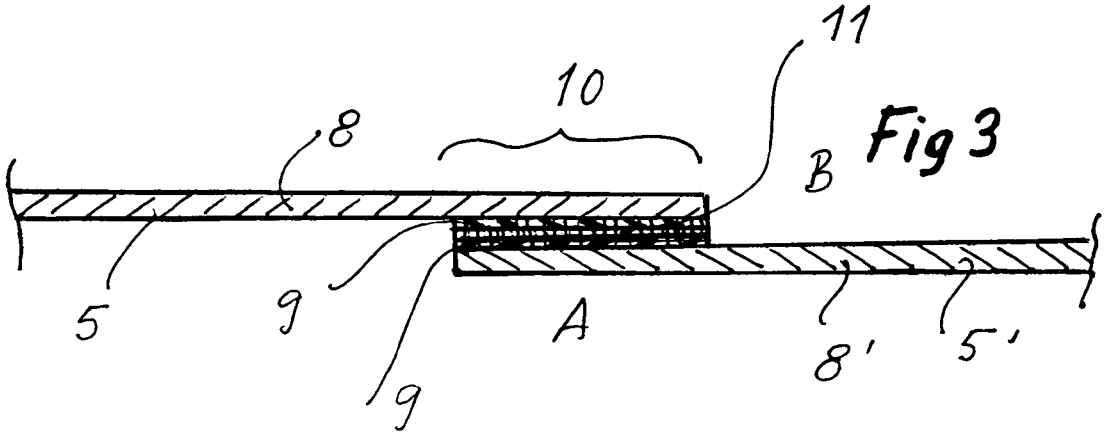
Figure 4:
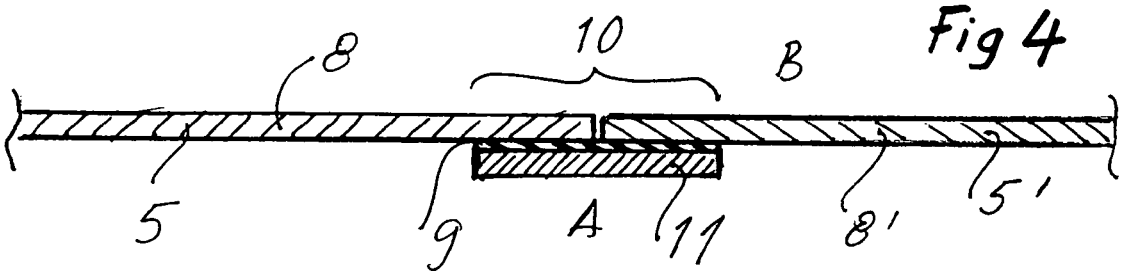
Figure 5:
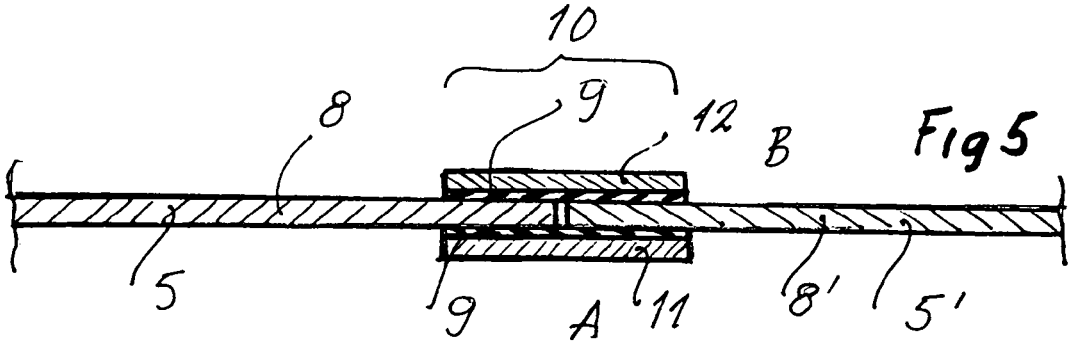

This solution is shown in the FIG. 2, where the inside surface of the balloon is the one shown on the lower side (indicated with A, also in the FIGS. 3 through 5). The polyurethane film 9 presents the advantage that it permits cost-efficient treatment of the fabric 8, facilitates the HF welding process considerably, and is very resistant at low temperatures, which prevail e.g. if the balloon is used in winter time for illuminating a (cross-country) skiing run. Furthermore the polyurethane is very resistant against mechanical friction, as it presents high elasticity, which precludes tearing. Overall, this is to be considered as an ideal material for a coating layer lining the inner surface of the balloon fabric, apt to render the balloon airtight and to permit high frequency welding of the segments 5, 5', 5'', 5''', etc.

According to another preferred form of realization of the present invention, shown in the FIGS. 3 and 4, it is provided that along the connecting and/or overlapping zone 10 of two neighboring segments 5, 5' between the two fabric layers 8 a strip 11 of polyester for the welding process is inserted between the two fabric layers 8, which on at least one side is coated with a polyurethane film 9. During the HF welding process the polyurethane film 9 melts and is "glued" airtight to the corresponding fabrics 8, 8' of the segments 5, 5' of the balloon 1.

According to a further preferred form of realization of the present invention shown in the FIG. 4, it is provided that a polyester strip 12 is placed also on the outer side B of the connecting and/or overlapping zone 10 of two neighboring segments 5, 5', which on its side B oriented outwards away from the ball is provided with a polyurethane layer 9. The advantage of this solution—obviously—consists in that an "inner" polyester strip 11 as well as an "outer" polyester strip 12 are present, each of which is provided with intermediate layers of the thermoplastic material 9, which arrangement permits that a "double" welding is obtained in the high frequency welding process and that thus higher, if not doubled, mechanical resistance and air tightness is ensured.

According to a further form of realization of the present invention it is provided that the layer 9 lining the inside A of the balloon also presents high light reflection properties. This property can be concentrated in the upper part of the cap of the balloon 1 in such a manner that the light predominantly is reflected downward.

According to a further preferred form of realization of the present invention it is provided that the width of the connecting and/or overlapping zone 10 of two neighboring segments 5, 5' ranges between 1 and 3 cm, and preferentially is 2 cm. These dimensions ideally permit manufacturing of inflatable balloons, which are absolutely airtight, and the diameter of which ranges between 80 cm and 3 m in such a manner that almost all requirements occurring in practice for "temporary" illumination (events, construction sites, rod accident scenes, etc.) can be met.

A further preferred form of realization of the present invention then provides that the air in the balloon 1 is maintained under constant pressure with the help of a compressor (not shown), which feeds air via the support rod 2 and the connecting disc 7 into the balloon 1—according to the requirements—continually or intermittently.

Obviously, the better the air tightness of the balloon is, the less frequent is the necessity of re-establishing the air pressure in the balloon 1. However, as no fabric remains 100% airtight over any length of time, and as no connecting seams, however well laid out, can ensure absolute air tightness between the fabric segments or between the fabric and e.g. the connecting disc 7, provision of a pump or of a compressor proves useful if the air pressure prevailing in the balloon 1 is to be maintained constant.

Of course the use of this pump is reduced to an advantageous minimum owing to the present invention, along with all the advantages this offers.

According to another form of realization of the present invention it finally is provided that the air pressure prevailing inside the balloon 1 is maintained between 8 and 15 millibar: this represents a very low value, which however proves amply sufficient to ensure perfect functioning of the inventive balloon 1.

Figure 6:
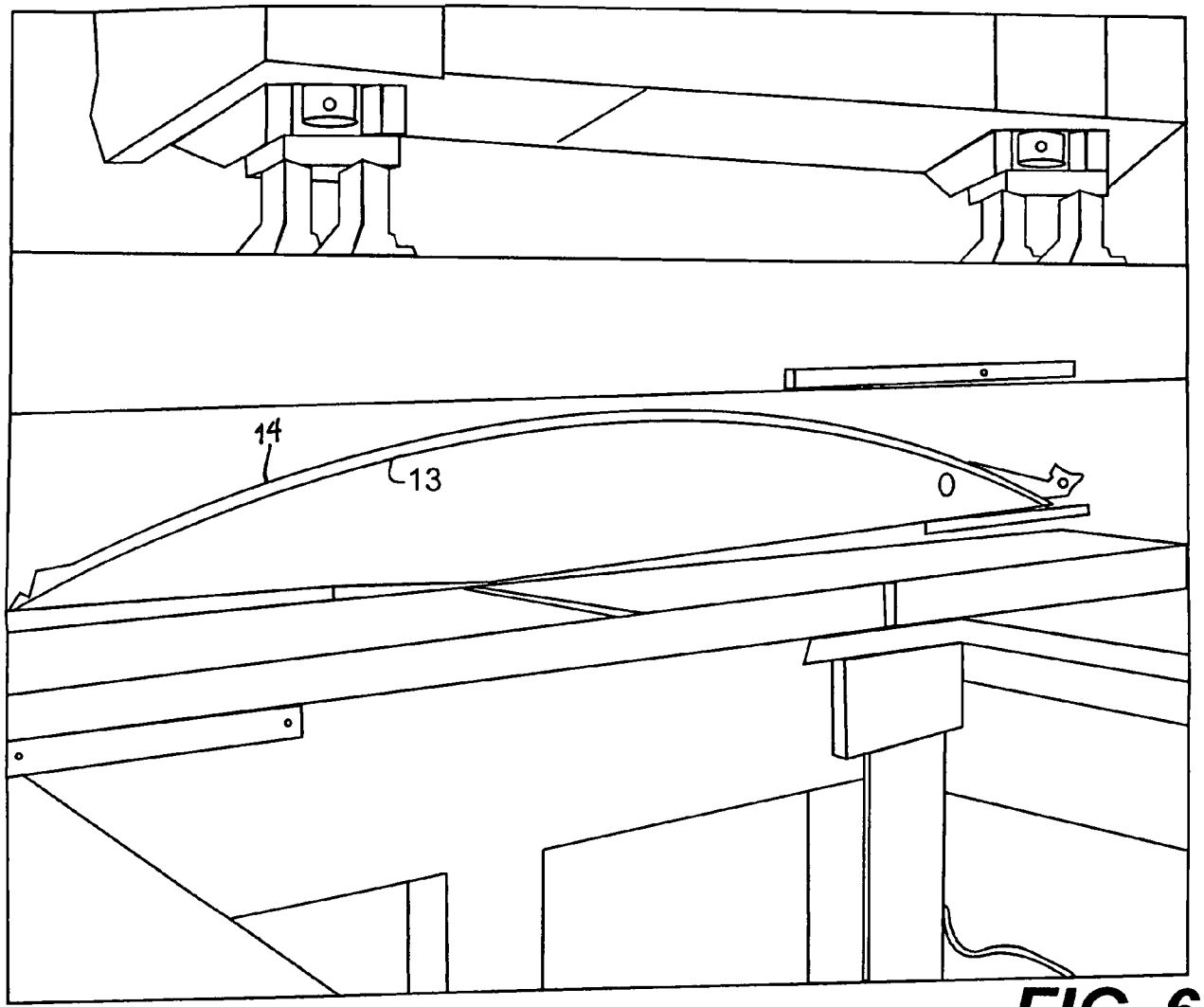
FIG. 6 An overall view of a machine for high frequency (HF) welding with a stamp and a counter-piece, which are adapted to the bow shape of the segment.

In the FIG. 6 finally, merely in the sense of presenting additional information, an overall view of a high frequency welding machine is shown. In this arrangement a lower stamp 13 of convex shape can be seen which corresponds to the meridian line of the segment 5 of the balloon 1 to be produced, as well as an upper stamp 14, which presents the same arc shape as the stamp 13 but in a concave layout: Between the two stamps 13 and 14 the rim zones of the two segments 5, 5' to be welded are inserted, and above and/or below these rim zones the strips 11 and/or 12 are placed as described before in the context of the forms of realization shown in the FIGS. 3 to 5.

Welding then is effected under pressure, the two stamps 13 and 14 being pressed against each other under high pressure and under application of high frequency electric current, the power of which is adapted to the task to be performed. All these indications correspond to the state of the art and are well known to the specialist in the field. A more detailed description thus can be dispensed with here.

The advantage of the present invention is seen mainly in that balloons inflatable with air for illuminating purposes can be produced cost-efficiently, as they are made from low-cost fabrics such as polyester or polyamide (nylon) impregnated with polyurethane, and which ensure high air tightness, in such a manner that the effort to maintain the balloon always in perfectly filled shape is reduced to a minimum.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS USED IN THE FIGURES

1 balloon
2 support rod
3 tripod
4 lower pole
5 segment
6 meridian line
7 connecting disc
8 fabric
9 fabric of thermoplastic material
10 overlapping zone
11 strip for welding
12 strip
13 lower stamp
14 upper stamp

What is claimed:

1. An inflatable balloon inflatable with compressed air, comprising:

an illumination light source at a center of the inflatable balloon;

an essentially spherical body comprising a plurality of segments forming meridians and which segments are mutually interconnected, wherein the segments are composed of a particularly air-impermeable fabric;

a connecting rod;

a connecting disc at a lower pole of the essentially spherical body to which all of the plurality of segments merge and which connects the inflatable balloon in substantially airtight manner with the connecting rod;

seams comprising at least one of a connecting zone and an overlapping zone of two adjacent segments; and at least one thermoplastic intermediate layer structured and arranged to form an airtight connection at the seams between the two adjacent segments, wherein the seams mutually interconnect the segments along a meridian line of the inflatable balloon.

2. The inflatable balloon of claim 1, wherein the seams are structured and arranged for welding using a high frequency (HF) welding process.

3. The inflatable balloon of claim 1, wherein the at least one thermoplastic intermediate layer is structured and arranged to form the airtight connection through a high frequency (HF) welding process.

4. The inflatable balloon of claim 1, wherein the particularly air-impermeable fabric is a polyester or polyamide (nylon) fabric.

5. The inflatable balloon of claim 1, wherein the at least one thermoplastic intermediate layer:

is arranged lining the particularly air-impermeable fabric of the inflatable balloon on its inside; and comprises a polyurethane film.

6. The inflatable balloon of claim 5, wherein the at least one thermoplastic intermediate layer provides a high light reflection property.

7. The inflatable balloon of claim 1, wherein the at least one thermoplastic intermediate layer:

comprises a polyester welding strip coated at least on one of its sides with a polyurethane film; and is arranged between fabric layers of the two adjacent segments along at least one of the connecting zone and the overlapping zone.

8. The inflatable balloon of claim 1, wherein the at least one thermoplastic intermediate layer:

comprises a polyester welding strip coated with a polyurethane film at least on an outer side oriented outwards away from the inflatable balloon; and is arranged on an outside of fabric layers of the two adjacent segments along at least one of the connecting zone and the overlapping zone.

9. The inflatable balloon of claim 1, wherein the at least one of the connecting zone and the overlapping zone of the two adjacent segments comprises a width of between approximately 1 cm and 3 cm.

10. The inflatable balloon of claim 9, wherein the width is 2 cm.

11. The inflatable balloon of claim 1, further comprising a compressor structured and arranged to feed air into the inflatable balloon via the connecting rod and the connecting disc, wherein air inside the inflatable balloon is maintained under constant pressure with the compressor.

12. The inflatable balloon of claim 11, wherein the compressor is structured and arranged to feed air into the inflatable balloon one of continually and intermittently.

13. The inflatable balloon of claim 11, wherein the constant pressure ranges between 8 and 15 millibar.

14. The inflatable balloon of claim 1, wherein the illumination light source comprises an electric lamp.

15. A method of making the inflatable balloon of claim 1, comprising:

positioning the at least one thermoplastic intermediate layer within the at least one of the connecting zone and the overlapping zone of the two adjacent segments; and high frequency (HF) welding the at least one of the connecting zone and the overlapping zone to melt the at least one thermoplastic intermediate layer, whereby a solidification of the at least one thermoplastic intermediate layer forms the airtight connection.

16. An inflatable balloon inflatable with compressed air, comprising:

an illumination light source at a center of the inflatable balloon;

an essentially spherical body comprising a plurality of segments forming meridians and which segments are mutually interconnected, wherein the segments are composed of a particularly air-impermeable fabric;

a connecting rod;

a connecting disc at a lower pole of the essentially spherical body to which all of the plurality of segments merge and which connects the inflatable balloon in substantially airtight manner with the connecting rod;

at least one thermoplastic intermediate layer along at least one of a connecting zone and an overlapping zone of two adjacent segments; and welded seams comprising the at least one thermoplastic intermediate layer within the at least one of the connecting zone and the overlapping zone of the two adjacent segments providing an airtight connection along the welded seams to mutually interconnect the segments along a meridian line of the inflatable balloon.

* * * * *